US006959518B2

(12) United States Patent
Cousin

(10) Patent No.: US 6,959,518 B2
(45) Date of Patent: Nov. 1, 2005

(54) RAIL SECTION FOR FIXING A STRETCHED WEB, FALSE PARTITION SUCH AS A FALSE CEILING OR FALSE WALL COMPRISING SAME

(75) Inventor: Etienne Cousin, Haubourdin (FR)

(73) Assignee: Newmat S.A., Haubourdin (FR)

( * ) Notice: Subject to any disclaimer, the term of this patent is extended or adjusted under 35 U.S.C. 154(b) by 59 days.

(21) Appl. No.: 10/070,776

(22) PCT Filed: Jul. 11, 2001

(86) PCT No.: PCT/FR01/02245

§ 371 (c)(1),
(2), (4) Date: Apr. 8, 2002

(87) PCT Pub. No.: WO02/06604

PCT Pub. Date: Jan. 24, 2002

(65) Prior Publication Data

US 2002/0194802 A1 Dec. 26, 2002

(30) Foreign Application Priority Data

Jul. 13, 2000 (FR) ..... 00 09186

(51) Int. Cl.[7] ..... E04B 9/00

(52) U.S. Cl. ..... 52/273; 52/222; 52/506.06; 160/392; 160/395

(58) Field of Search ..... 52/222, 273, 506.05, 52/506.06, 287.1, 63; 24/555, DIG. 50, 460, 462; 160/391, 392, 395, 427, 328, 327

(56) References Cited

U.S. PATENT DOCUMENTS

| | | | |
|---|---|---|---|
| 4,083,157 | A | 4/1978 | Anthonioz |
| 5,058,340 | A | 10/1991 | Muller |

FOREIGN PATENT DOCUMENTS

| | | |
|---|---|---|
| EP | 0 043 466 | 1/1982 |
| EP | 0 089 905 | 9/1983 |
| EP | 0 215 715 | 3/1987 |
| EP | 0 281 468 | 9/1988 |
| EP | 0 338 925 | 10/1989 |
| EP | 0 504 530 | 9/1992 |
| EP | 0 588 748 | 3/1994 |

(Continued)

*Primary Examiner*—Brian E. Glessner
(74) *Attorney, Agent, or Firm*—Ladas & Parry LLP

(57) ABSTRACT

The invention concerns a rail section for false stretched fabric partitions, said section (3) comprising at least a groove (10) defined by two lateral walls (5, 7) and a base wall (6), said groove (10) being designed to contain at least an edge of the stretched fabric (1) after it has been mounted into the rail (3), said section being in one single piece and comprising a joint (12) for retaining the edge of the stretched fabric (1) in said groove (10), said joint (12) being made of a material having a flexibility different from that of the material constituting the walls (5, 6, 7) of said groove (10). The invention also concerns false stretched fabric partitions, such as false ceilings or false walls, said fabrics being stretched in a frame obtained by assembling such sections.

27 Claims, 5 Drawing Sheets

FOREIGN PATENT DOCUMENTS

| | | |
|---|---|---|
| EP | 0 643 180 | 3/1995 |
| EP | 0 652 339 | 5/1995 |
| FR | 1 287 077 | 1/1962 |
| FR | 1 303 930 | 8/1962 |
| FR | 1 475 446 | 3/1967 |
| FR | 1 515 260 | 3/1968 |
| FR | 2 002 261 | 10/1969 |
| FR | 2 078 579 | 11/1971 |
| FR | 2 106 407 | 5/1972 |
| FR | 2 145 147 | 2/1973 |
| FR | 2 175 854 | 10/1973 |
| FR | 2 202 997 | 5/1974 |
| FR | 2 270 407 | 12/1975 |
| FR | 2 310 450 | 12/1976 |
| FR | 2 475 093 | 8/1981 |
| FR | 2 486 127 | 1/1982 |
| FR | 2 523 622 | 9/1983 |
| FR | 2 524 922 | 10/1983 |
| FR | 2 531 012 | 2/1984 |
| FR | 2 537 112 | 6/1984 |
| FR | 2 552 473 | 3/1985 |
| FR | 2 561 690 | 9/1985 |
| FR | 2 587 392 | 3/1987 |
| FR | 2 587 447 | 3/1987 |
| FR | 2 592 416 | 7/1987 |
| FR | 2 597 906 | 10/1987 |
| FR | 2 611 779 | 9/1988 |
| FR | 2 619 531 | 2/1989 |
| FR | 2 623 540 | 5/1989 |
| FR | 2 624 167 | 6/1989 |
| FR | 2 627 207 | 8/1989 |
| FR | 2 630 476 | 10/1989 |
| FR | 2 645 135 | 10/1990 |
| FR | 2 658 849 | 8/1991 |
| FR | 2 685 036 | 6/1993 |
| FR | 2 688 849 | 9/1993 |
| FR | 2 691 193 | 11/1993 |
| FR | 2 692 302 | 12/1993 |
| FR | 2 695 670 | 3/1994 |
| FR | 2 699 206 | 6/1994 |
| FR | 2 699 211 | 6/1994 |
| FR | 2 699 613 | 6/1994 |
| FR | 2 703 711 | 10/1994 |
| FR | 2 707 708 | 1/1995 |
| FR | 2 712 006 | 5/1995 |
| FR | 2 712 325 | 5/1995 |
| FR | 2 715 682 | 8/1995 |
| FR | 2 727 711 | 6/1996 |
| FR | 2 734 296 | 11/1996 |
| FR | 2 736 615 | 1/1997 |
| FR | 2 751 682 | 1/1998 |
| FR | 2 756 600 | 6/1998 |
| FR | 2 767 748 | 3/1999 |
| FR | 2 767 851 | 3/1999 |
| WO | WO 92/18722 | 10/1992 |
| WO | WO 94/12741 | 6/1994 |
| WO | WO 96/35846 | 11/1996 |

RAIL SECTION FOR FIXING A STRETCHED WEB, FALSE PARTITION SUCH AS A FALSE CEILING OR FALSE WALL COMPRISING SAME

FIELD OF THE INVENTION

The invention relates to the technical field of stretched false ceilings and walls.

A large number of embodiments using such false ceilings are already known in the prior art.

BACKGROUND OF THE INVENTION

By way of examples, reference can be made to the patent applications in France published under the following numbers: 2 767 851, 2 751 682, 2 734 296, 2 712 006, 2 707 708, 2 703 711, 2 699 211, 2 699 209, 2 695 670, 2 691 193, 2 688 849, 2 685 036, 2 645 135, 2 630 476, 2 627 207, 2 624 167, 2 623 540, 2 619 531, 2 597 906, 2 611 779, 2 592 416, 2 587 447, 2 561 690, 2 587 392, 2 552 473, 2 537 112, 2 531 012, 2 524 922, 2 475 093, 2 486 127, 2 523 622, 2 310 450, 2 270 407, 2 202 997, 2 175 854, 2 145 147, 2 106 407, 2 078 579, 2 002 261, 1 475 446, 1 303 930, 1 287 077.

By way of examples, reference can also be made to the following documents: U.S. Pat. Nos. 5,058,340, 4,083,157, EP-A-643 180, EP-A-652 339, EP-A-588 748, EP-A-504 530, EP-A-338 925, EP-A-281 468, EP-A-215 715, EP-A-089 905, EP-A-043 466, WO-A-94/12741, WO-A-92/18722.

Reference can further be made to the following patent applications in France originating from the Applicant: 2 736 615, 2 756 600, 2 727 711, 2 712 325, 2 699 613, 2 695 670, 2 692 302, 2 658 849.

The materials known in the prior art for manufacturing false stretched ceilings or walls are most often polymers provided with a large number of qualities such as in particular fire resistance, air tightness, that is being dust-proof and damp-proof, and ease of maintenance.

False ceilings obtained by means of such materials can incorporate heat insulants, spot lights or various lighting elements, as well as ventilation or aeration openings or sprinklers.

As said false ceilings are dismountable, any intervention can be made in the plenum chamber of an air heater.

The polymers for stretched ceilings known in the prior art, regardless of whether they are translucid or opaque, possibly mass-tinted, matt, lacquered, marbled, suede or satin lustre, can thus be used both in an industrial and hospital environment, for collective equipment, laboratories or dwellings.

The lacquered finishing makes it possible to obtain a mirror effect used in shopping centres, a matt finishing appearing similar to a plaster aspect being most usually used for conventional decorations.

In a prior technique, the stretched fabrics or sheets on the roof or wall were definitively fixed by means of points or staples.

The conventional stretched false ceilings currently include:

firstly, a horizontal frame fixed onto the upper portion of the walls of a room, said frame being an external rail formed by sections joined end to end, secondly, a web stretched horizontally inside said frame.

This arrangement enables the stretched ceiling to be dismantled.

Keeping the web in place with respect to the rail frame is obtained by various means, some examples of same being given below.

According to a first type of embodiment, the rail comprises a U-shaped groove defined by two walls, one of the two walls having a lip orientated towards the bottom of the groove, hooks being placed on the periphery of the web positively being anchored on this lip.

As regards this first type of embodiment, reference can be made to the document FR-A-1 303 930.

According to a second type of embodiment, the rail includes an U-shaped groove defined by two walls, one of the latter comprising a shoulder having one portion situated towards the bottom of groove to form a stop.

As regards this second type of embodiment, reference can be made for example to the documents FR-A-1 475 446, FR-A-2 002 261.

According to a third type of embodiment, the rail is a flat section, the web being squeezed between said section and the wall on which said section is fixed.

As regards said third type of embodiment, reference can be made for example to the document FR-A-2 734 296.

According to a fourth type of embodiment, the rail is provided with means forming a fitting and tension clamp.

As regards this fourth type of embodiment, reference can be made for example to the documents FR-A-2 699 211 and FR-A-2 537 112.

According to a fifth type of embodiment, the rail is provided with a groove to which hook-shaped elements cling in the way of a fish-hook and integral with the web.

As regards this fifth type of embodiments, reference can be made for example to the documents FR-A-2 630 476, EP-A-388 925.

Within the context of stretched ceilings of the prior art, regardless of means used for maintaining tension of the web on the rail frame (stops, cramps, fish-hooks, clamping, latching . . . ) the rails are conventionally made of extruded polymer or an aluminium alloy.

The stretched false ceilings are moreover mostly mounted with the web fully stretched horizontally.

In certain particular embodiments, as the web is stretched on a horizontal rail frame fixed to the walls of a room, deformations of the stretched web occur, as described in the documents FR-A-1 515 260 or EP-A-281 468.

Considering that in certain embodiments the stretched ceilings had the drawback of showing the lower portion of the rail used to fix them, certain installers have offered the use of complex sections only partially masking said rail.

Thus, for example, the document EP-A-338 925 describes a rail comprising a recess defined by two vertical wings of different heights, namely a first wing of smaller height terminating towards the bottom by a shoulder extending horizontally in the direction of the second wing, and a second wing of greater height; a "fish-hook" integral with the edge of a fabric able to be engaged between the two wings so as to take support on the shoulder of the first wing, said fabric of the stretched ceiling thus being deviated upwards so as to penetrate into the recess whilst taking support and being deviated against the lower extremity of the second wing.

As specified in said prior document, a clip or finishing cover is provided to cover the lower portion of the rail. In other words, the complex section described in the document EP-338 925 remains visible as long as a finishing cover is not installed, which proves to be a long and tedious operation.

The document FR-2 619 531 describes in relation to a false ceiling or stretched false wall a rigid PVC rail provided with a recess defined by two vertical wings of different heights, namely a first wing of small height next to a wall and ending towards the bottom by a mobile perforated tongue extending in an oblique direction towards the higher second wing; a fish-hook integral with the edge of a fabric able to be engaged between the two wings so as to take support both on the second wing and the perforated mobile tongue, said fabric of the stretched ceiling being thus deviated upwards so as to penetrate inside the recess by coming to rest and being deviated against the lower extremity of the second wing.

The rail described in the document FR-A-2 619 531 has a large number of drawbacks. In particular, it remains visible after it has been mounted. Having regard to its small tapered section, the mobile tongue does not allow the fish-hook to be properly held in place. Increasing the tongue section would a priori reduce this problem but would make it more difficult to place the forked-tie.

The document FR-A-2 597 906 describes, as regards a false ceiling or a false stretched wall, a rail provided with a recess defined by two vertical wings of different heights, namely a first wing of very small height close to a wall and a second wing of greater height; a forked-tie integral with the edge of a fabric able to be engaged between said two wings so as to fasten onto the second wing, said fabric of the stretched ceiling being thus deviated upwards so as to penetrate inside the recess whilst taking support and being deviated against the lower extremity of the second wing.

The rail described in the document FR-A-2 597 906, just like those of the documents FR-A-2 619 531 or EP-A-338 925, remains visible and, so as to mask the slit formed between the edge of the fabric and the wall on which the rail is fixed, a finish profile needs to be provided.

SUMMARY OF THE INVENTION

A first object of the invention is to provide a rail section for a false wall, said section able to be qualified as being invisible after the stretched fabric is mounted, this invisibility being obtained without fitting any type of finishing cover, said section ensuring a quick and safe fitting of the false partition fabric and having moreover a sufficiently simple construction so as to remain inexpensive.

With this aim in view, the invention relates according a first characteristic to a rail section for stretched fabric false partitions, said section comprising at least one groove defined by two lateral walls and a base wall, said groove being intended to contain at least one edge of the stretched fabric after it has been mounted in the section, said section being made of a single piece and comprising a joint for retaining the edge of the stretched fabric in said groove and being made of a material having a flexibility differing from that of the material constituting the walls of said groove.

The cross section of said groove has a general U, V, pseudo-U or pseudo-V shape, the extreme portions of the lateral walls of the groove opposite the base wall of the groove defining an opening at least partially blocked by the joint for keeping the edge of the fabric stretched.

According to a first type of conception, the joint comprises a single lip projecting from one of the lateral walls of said groove, known as joint support wall, said lip comprising an internal face opposite the base wall of the groove and an opposing external face.

According to a first series of embodiments, the sections of said first type of conception have the following characteristics, possibly combined:

- the lip joint is an approximately flat joint, the internal face of the lip being approximately parallel to its external face,
- the single lip of the joint extends approximately perpendicularly or along an angle of several degrees and about 65° with respect to the support wall.
- the free edge of the lip is placed inside the groove.
- the free edge of the lip is approximately in support against the lateral wall of the groove placed opposite the joint support wall,
- the single joint projects from the extreme part of its support wall.

According to a second series of embodiments, the sections of the first type of conception have the following characteristics, possibly combined:

- the lip of the joint comprises an internal face turned towards the base wall of the groove and an external opposing face, the internal face and the external face of the joint not being parallel to each other,
- the internal face of the single lip of the joint extends approximately perpendicular to its support wall or along an angle of several degrees and about 65° with respect to its support wall,
- the free edge of the lip is placed inside the groove,
- the free edge of the lip is substantially in support against the lateral wall of the groove placed opposite the joint support wall,
- the single lip projects from the extreme portion of its support wall,
- the external face of the single lip extends approximately perpendicular to the lateral walls of the groove.

According to a second type of design, the joint comprises two lips, projecting from one of the lateral walls of said groove, known as a joint support wall, namely a first lip known as a support lip and a second lip known as a masking lip, the internal face of the first lip, turned towards the base wall of the groove, being slanted with respect to the joint support wall, the external face of the second lip opposite the base wall of the groove being approximately perpendicular to the joint support wall.

According to a first series of embodiments, the section of the second type of design has the following characteristics, possibly combined:

- the two lips project from the extreme portion of the joint support wall,
- the free edge of the first lip is in support against the lateral wall of the groove placed opposite the joint support wall,
- the internal face of the first lip is slanted by an angle of several degrees and about 65° with respect to the joint support wall.

According to a second series of embodiments, the sections of the second type of design have the following characteristics, possibly combined:

- the joint comprises two lips, each lip projecting from one lateral wall of said groove and comprising an internal face opposite the base wall of the groove and an external face opposite,
- said two lips are approximately symmetrical with respect to a plane perpendicular to the base wall of the groove and placed halfway to the two lateral walls of the groove,
- the internal face of at least one of the two lips is slanted by an angle of several degrees about 65° with respect to the support lateral wall of said lip or extends approximately perpendicularly to the support wall of said lip,
- the external face of at least one of the two lips extends approximately perpendicularly to the support wall of said lip.

The lateral walls of the groove are made of an approximately rigid material selected from a group including metal alloys and rigid polymers, the joint being made of an approximately flexible material such as a flexible polymer.

The sections mentioned above can be obtained by co-extrusion or duplicate moulding of different materials, namely a first material constituting the approximately rigid walls of the groove, and a second material constituting the joint.

In one type of embodiment, the groove is made of rigid PVC-based material, possibly recycled, the joint being made of a flexible PVC.

In one particular embodiment, the section comprises an external wing from which perpendicularly projecting is a core bearing on projection an internal wing, said wing being approximately parallel to the lower section of the external wing, the internal wing and the lower section of the external wing constituting the lateral walls of said groove, the core of the section constituting the base wall of said groove, the upper portion of the external wing comprising a C-shaped groove able to receive means for assembling the two portions of the sections joined end-to-end.

According to a second aspect, the invention concerns false walls comprising a stretched fabric fastened along its edges to a support onto the walls of a room, said support comprising a rail formed of portions of sections as mentioned above, the edge of the fabric being provided with an excess thickness in support against the internal face of the joint.

These false walls, used as false ceilings, may be fixed so that the groove of the rail is oriented downwards, the lateral walls of the groove being approximately vertical, a first lateral wall of the groove being mounted close to a wall and the second lateral wall of the groove being situated towards the inside of the room, the joint extending projecting from the lower extreme part of the first lateral wall, the excess thickness of the fabric edge being forcefully introduced upwards between the free edge of the joint and the second lateral wall of the groove so that the excess thickness takes support against the internal face of the joint and against the internal face of the second lateral wall of the groove, the fabric stretched horizontally thus being deviated upwards so as to penetrate into the groove of the section, whilst taking support on the lower extreme edge of the second lateral wall of the groove.

In one embodiment, the two lateral walls of the groove have identical heights, the external face of the joint being placed approximately perpendicular to said lateral walls, and so on in the continuity of the stretched fabric.

In another embodiment, the two lateral walls of the groove have different heights, the lateral first wall of the groove close to the wall having a smaller height than the second lateral wall, the external face of the joint being slanted so as to constitute a continuity solution between the extension plane of the stretched fabric and the lower extremity of the first lateral wall.

According to one type of embodiment, the external face of the joint is made of a material having a colour, tint and brilliance identical to or coordinated with those of the stretched fabric, the remaining of the section having a standard colour, tint and brightness.

To limit the risks of damaging the fabric when it is placed, the lower extremity of the second lateral wall of the groove under which the stretched fabric takes support is rounded.

In one particular embodiment, the false wall includes two horizontally coplanar stretched fabrics, the edges of said stretched fabrics being kept in the groove of a section fixed under the ceiling of a room, said section comprising an upper horizontal core extended downwards by a vertical central wing and two lower horizontal wings situated on both sides of the vertical central wing, the horizontal wings constituting the lateral walls of two opposing grooves and a joint support for keeping the edge excess thicknesses of the fabrics stretched.

Other objects and advantages of the invention shall appear in the following description of the embodiments, said description being given with reference to the accompanying drawings showing in cross-sectional views the various embodiments of the sections of the invention.

In the continuation of this description, the word "fabric" shall be designated by webs able to be made of a material selected from the group comprising woven or non-woven textiles fibres, polymer films, especifically vinyl polychloride, vinydilene polychloride.

It is understood that when said web is a polymer, it could be:

- provided with a silk screen printing or ink jet numerical printing,
- translucent or opaque, possibly tinted in the mass so as to have a wide variety of tints,
- provided with a matt, lacquered, marbled, suede or satin lustre finish,
- provided with a flock coating to give it a velvet or fabric aspect. The surface of the fabric is for example coated with a suitable adhesive for finely cut textile fibres, the flock fibres being applied by sieving and beating or pressure projection, or even by electrostatic means when it is desired to obtain a high density of fibres,
- provided with holes, micro-perforations and/or micro-reliefs, for example constituted by planishing and/or coated with an anti-reflecting coating so as to improve its acoustic properties, in particular its acoustic absorption coefficient.

When said web is made of a polymer, its thickness is typically between several tenths of a millimeter and several millimeters.

The fabric kept tensioned can be effected by assembling several cloth identical widths, especially as regards their colours, tints, surface aspects, finish, printing and dimension.

Thus, for example many widths of polymer sheets of different widths and tints can be assembled by butt welding so as to constitute a cameo.

Spotlight frames, passages for sprinklers or pipes can be fixed by known means through the stretched fabric.

BRIEF DESCRIPTION OF THE DRAWINGS

After having set forth these general points, several embodiments of the invention shall hereafter be described, taken in conjunction with the accompanying drawings in which.

DETAILED DESCRIPTION OF THE INVENTION

Figure 1:
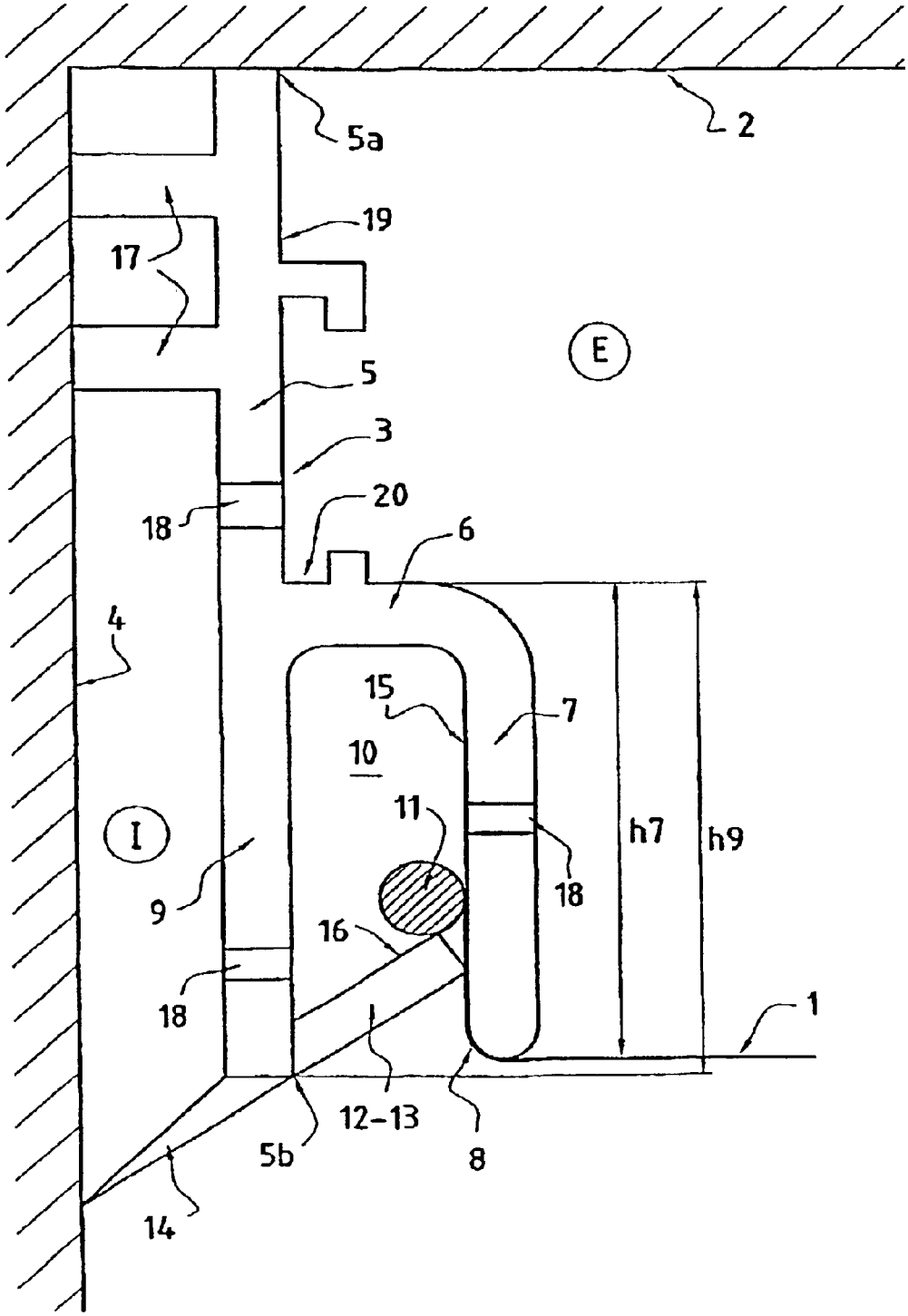
FIG. 1 illustrates a first embodiment of a rail section for stretched fabric false partitions according to the present invention.

First, reference is made to FIG. 1.

FIG. 1 shows the extreme portion of a false ceiling comprising a fabric 1 stretched horizontally under a ceiling 2 of a room. Said fabric 1 is fixed along its edges to a support comprising a rail section 3 fixed to the upper portion of a wall 4 of the room by fixing means (not shown), such as screws.

The rail section 3 comprises an external wing 5, approximately vertical and extending parallel to the wall 4 and close to the latter. Projecting from said external wing 5 is a core 6 approximately extending over a short distance, for example about several millimeters towards the inside of the room.

In the embodiment shown, the core 6 extends approximately to half the height of the external wing 5. In other embodiments (not shown), said core 6 is situated closer to the upper extreme edge 5*a* or the lower extreme edge 5*b* of the external wing 5.

The core 6 bears, on an approximately vertical projection, an internal wing 7 provided with a rounded lower extremity 8. Said internal wing 7 is approximately parallel to the lower section 9 of the external wing 5 so that a groove 10 with a U-shaped section opened towards the bottom is defined by the internal wing 7, the core 6 and the lower section 9 of the external wing 5.

In the embodiment shown in FIG. 1, the internal wing 7 extends over a height h7 smaller than that h9 off the lower section 9 of the external wing 5. In other embodiments (not shown), the height h7 is approximately equal to the height h9 or slightly greater than the latter.

The edge of the fabric 1 bears, at least in certain places, an excess thickness 11. In the embodiment of FIG. 1, said excess thickness 11 is a snap ring fixed for example by welding onto the fabric 1. In other embodiments (not shown), said excess thickness is shown as a cross section in the form of a hook extending towards the wall 4 and open towards the bottom. Said hook can for example be made of a semi-flexible extruded polymer and comprise a proximal portion for linking to the fabric 1, and a curved distal portion. According to another variant, said excess thickness could have a fish-hook shaped cross section.

As it shall be apparent to an expert in this field, the sections of the invention may be used without particularly adapting the main types fixing means secured to the edges of the stretched fabrics.

The lower section 9 of the external wing 5 bears a slanted joint 12.

In the embodiment of FIG. 1, said joint 12 comprises a first lip 13 inside the groove 10 and approximately in support against the internal wing 7, and a flap 14 outside the groove 10 plated against the wall 4, the first lip 13 and flap 14 being approximately aligned and placed along an angle of 45° with respect to the external wing 5. The first lip 13 approximately blocks off the groove 10, whereas the flap 14 closes the interval I separating the external wing 5 and the wall 4. The joint and the flap hide the material constituting the external wing 5 of the section from the view of any observer in the room.

In other embodiments, not shown, the first lip 13 and the flap 14 are not aligned. For example, the first lip 13 is slanted with respect to the external wing 5 by an angle smaller than the angle of inclination of the flap 14 with respect to said external wing 5.

In other embodiments, the joint 12 comprises no flap 14, the external wing 5 being in direct support on the wall 4.

The fabric 1, when it is fixed on the section 3, is introduced into the groove 10 by taking support on the rounded extremity 8 of the internal wing 7. Owing to this, the fabric 1 slides onto said rounded portion 8 without any risk of being damaged.

The fabric 1 is kept in place by being pinched between the first lip 13 of the joint 12 and the internal wing 7 of the groove 10. If necessary, the fabric can be also be kept in place or mainly by taking support on the excess thickness 11 against the internal face 15 of the internal wing 7 and against the internal face 16 of the first lip 13 of the joint 12.

In another embodiment (not shown), the excess thickness is kept squeezed between the internal face of the internal wing of the internal face of the external wing.

Placing the excess thickness 11 inside the groove 10 can be carried out for example by using a spatula so as make the excess thickness 11 pass between the first lip 13 of the joint 12 and the internal wing 7 and thus bring it into the groove 10 above the joint 12.

The first lip 13 of the joint 12 seals off the groove 10 and renders it undetectable to an occupant of the room who is looking at the ceiling from a normal distance.

In the embodiment shown on FIG. 1, the external wing 5 is placed at a short distance from the wall 4 by means of projections 17. This arrangement makes it possible for air to penetrate into the space E defined by the fabric 1 and the ceiling 2, the section 3 being provided with venting holes 18, the flap being also provided, here and there with traversing holes. In one variant, the flap has sufficiently slight flexibility to enable it to become warped when excess pressure enters the space I.

In the embodiment shown in FIG. 1, ventilation openings 18 are placed both on the internal wing 7 and the external wing 5. Thus, as shall be understood by an expert in this field, the ventilation holes can be placed solely on the external wing, the groove 10 having no holes.

In the embodiment of FIG. 1, the rail section 3 comprises on the internal face 19 of the external wing 5 a groove 20 with a C-shaped cross-section. This groove 20 is designed to receive a branch of a linking square or flat piece. The linking square makes it possible to assemble in each angle of the wall two rail sections perpendicular to each another. The linking flat piece makes it possible to butt-join the rail sections.

There now follows more specifically a description of the embodiment of the joint 12.

In a first type of embodiment, the joint 12 is pre-assembled on the extreme portion 5*a* of the external wing 5, for example by glueing or welding.

In a second embodiment, the joint 12 is produced with the rest of the rail section 3. According to a particular embodiment, the joint 12 is co-extruded with the rest of the rail section 3.

Here, the term "co-extrusion" means the simultaneous extrusion of several materials of the same type or totally different polymers in a single die, the materials not being mixed. Said co-extrusion can be carried out with a single die with separate channels.

According to a first embodiment, the joint 12 is made of polyvinyl chloride having a greater flexibility than polyvinyl chloride used for the rest of the rail section 3. This difference in flexibility can be obtained by using different plastifying agent contents, said plastifying agents able to be esters resulting from the action of mono or polybasic, aliphatic or aromatic acids. For example, said plastifying agents shall be phtalic (diotylephtalate, diisonosylphtalate) acid esters, adipic (butyl adipate, octyle adipate, diisonolyl adipate, benzyleoctyl adipate, acid esters, debacic (butyl sebacate, octyl sebacate) acid esters, phosphoric acid esters. These plastifying agents can be combined with sebacic, adipic or adipic-phtalic acid polyesters, or synthesis elastomers of butadiene copolymer and acrylic nitrile type.

For example, the joint 12 could be made of a flexible PVC charged with a 60% plastifying agent, the remaining of the rail being in rigid PVC charged with a 10% plastifying agent. The table below shows the differences of mechanical properties between the flexible PVCs (typically above 60 parts for 100 parts of PVC resin) and the rigid PVCs (typically less than 30 parts for 100 parts of resin).

| Property | Density (g/cm3) | Elongation on traction rupture (%) | Stress on traction rupture (Mpa) | Resistance to rupture on compression (Mpa) | Modulus of elasticity on bending (Mpa) |
|---|---|---|---|---|---|
| Flexible PVC | 1.2 | 200–450 | 10–25 | 6–12 | <2000 |
| Rigid PVC | 1.3–1.4 | 2–80 | 40–60 | 60–90 | 2000–3500 |

According to other embodiments, the joint 12 is made of polyvinyl chloride and the rest of the rail is made of polyethylene, impact polystyrene or styrene butadiene acrylonitrile.

The joint 12 could be coloured, tinted or brightnessy or have a different aspect from that of the rest of the rail section.

In one type of embodiment, the joint 12 is coloured, tinted or brightnessy and has an aspect closely related or coordinated with the fabric 1 so that the hook exhibits uniformity or has continuity of aspect with the fabric. As the rest of the rail is hidden from view, it could have a standard aspect and be made of a recycled or inferior material so as to reduce manufacturing costs.

In one particular embodiment, the joint 12 and/or the rest of the rail can be constituted by a two-grade material, namely a central portion of a lesser grade material and an elaborate aspect skin for all the visible portions, said skin being obtained by co-extrusion or flocking or by combining co-extrusion and flocking.

In one particular embodiment, the first lip 13 of the joint 12 is made of a polymer having a different nature or flexibility than those of the flap 14 of said joint 12. Thus for example, the flap 14 of the joint 12 shall be highly flexible so as to counterbalance all the irregularities in the surface evenness of the wall 4, whereas the first lip 13 of the joint 12 shall exhibit at least a high flexibility so as to keep the fabric 1 firm inside the groove 12 of the rail 3.

In one particular embodiment, the joint 12 is made of a polymer, the remaining portion of the rail being made of a metal alloy, both of these elements being obtained by duplicate moulding. Thus, it is possible to obtain both straight and curved sections.

Figure 2:
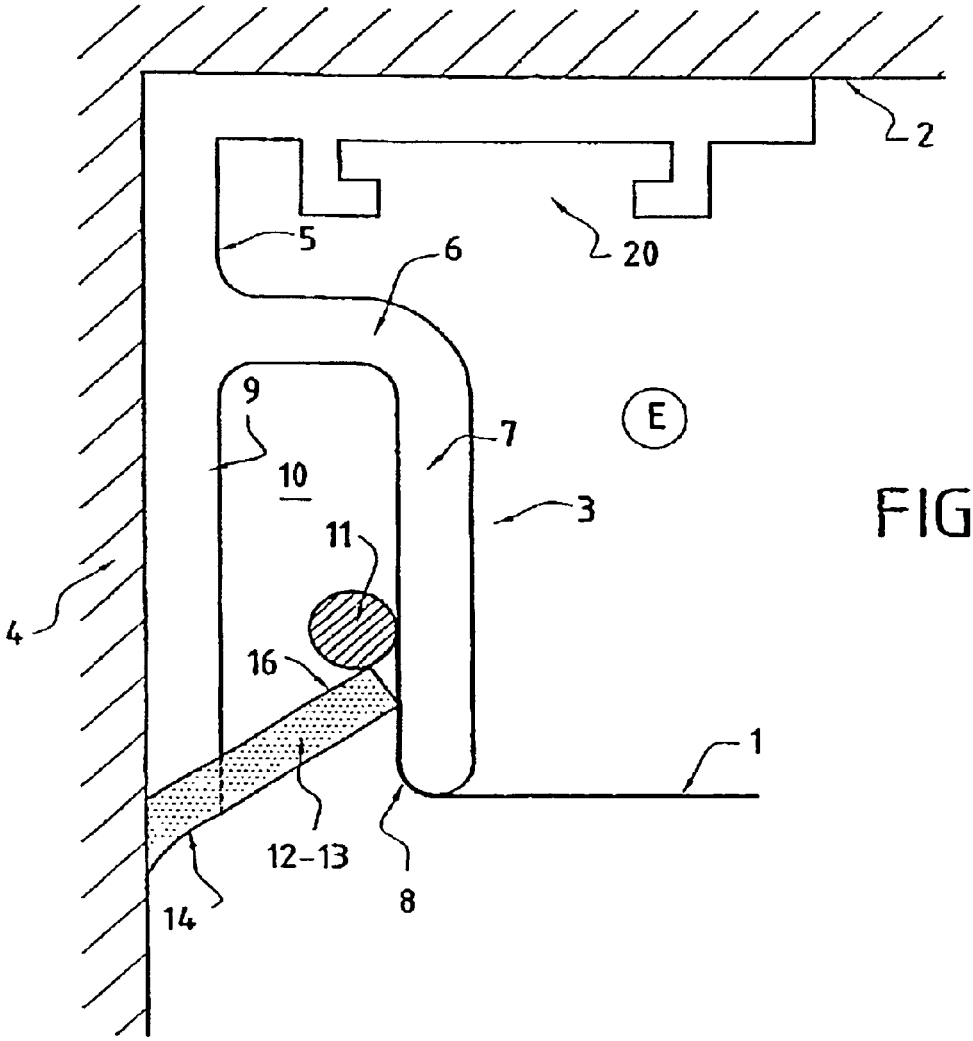
FIG. 2 illustrates a further embodiment of a rail section according to the present invention.

Reference is now made to FIG. 2 which illustrates one embodiment variant, the elements similar to those described above being designated by the same numerical references. The means for fixing the rail against the wall and/or the ceiling, such as screws, are not shown.

The main differences between the embodiment of FIG. 2 and that of FIG. 1 are as follows in the variant of FIG. 2:

- the flap 14 approximately marries the wall 4 against which the external wing 5 of the section 3 is plated,
- the upper portion of the external wing 5 is plated against the ceiling 2 so that the groove 20 is open towards the bottom.

The mounting of the fabric 1 on the rail 3 or assembling together of the rail portions by squares or linking rectangular bars as described with reference to FIG. 1 can be transposed to the embodiment of FIG. 2.

Figure 3:
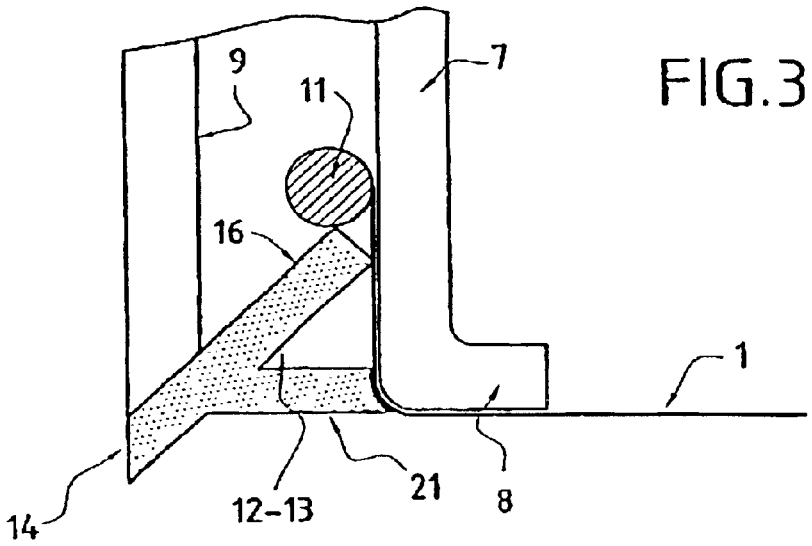
FIG. 3 illustrates a partial view of a still further embodiment of a rail section according to the present invention.

Reference is now made to FIG. 3 which is a detailed view of an embodiment variant of the joint 12. In this embodiment variant, the joint 12 comprises a first lip 13 slanted by an angle of about 45° with respect to the external wing 5, a flap 14 intended to take support against a surface such as a wall, and a second lip 21 whose lower face is approximately placed in the prolongation of the stretched fabric 1.

The second lip 21 lessens further the visual impact of the rail section 3 and makes it almost undetectable, especially when the visible face of said lip 21 is made of a material having the colour, tint or brightness of the stretched fabric 1.

Figure 4:
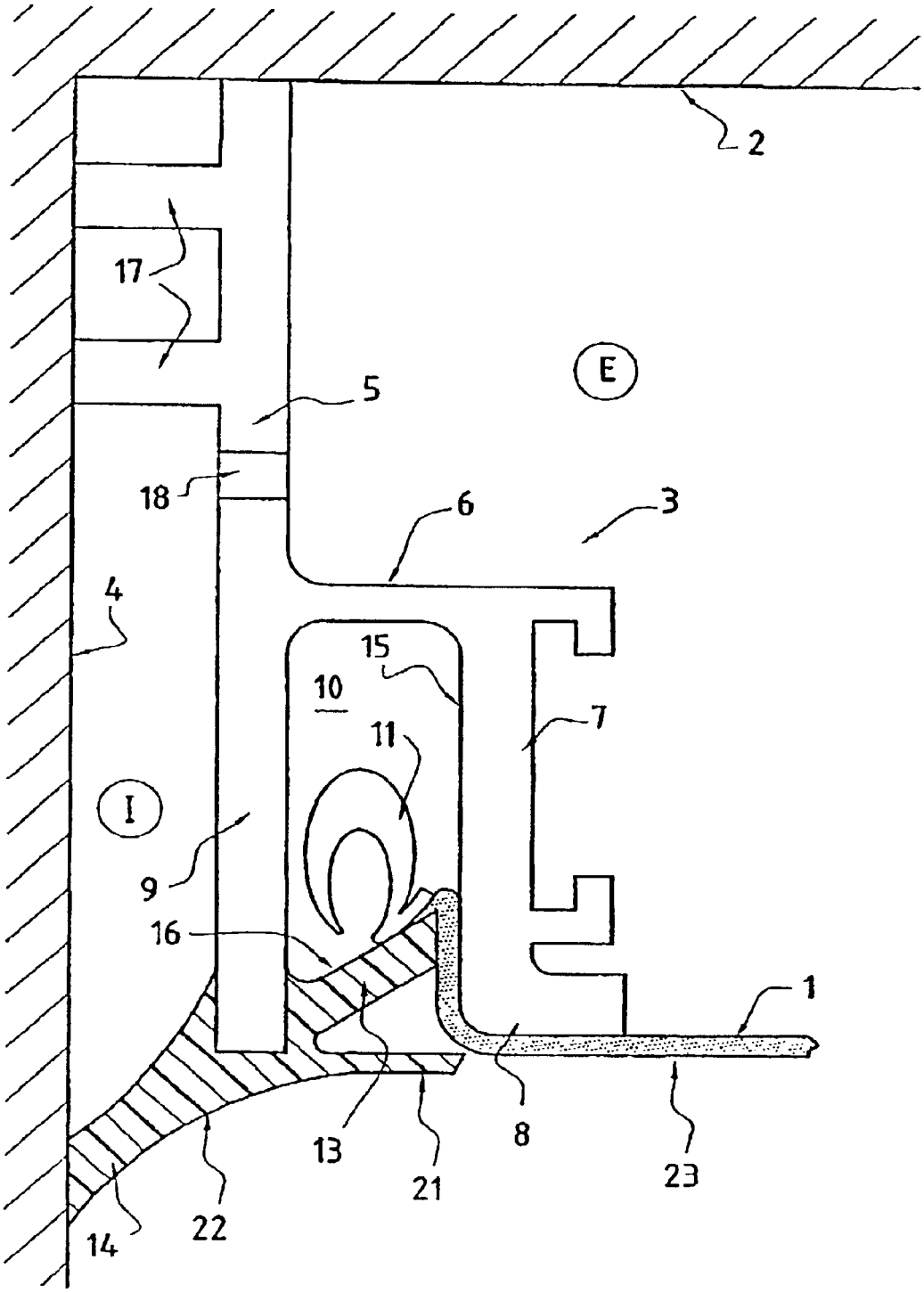
FIG. 4 illustrates a still further embodiment of a rail section according to the present invention.

Reference is now made to FIG. 4.

In the embodiment variant of FIG. 4, the joint 12 comprises a first lip 13 slanted with respect to the external wing 5, a second lip 21 approximately perpendicular to the external wing 5 and a flap 14.

According to one particular embodiment, the joint 12 is made of a monomaterial, for example, a flexible PVC, co-extruded with the rest of the section 3 which is made of a rigid PVC.

In another embodiment, the joint 12 is duplicate moulded onto the external wing 5, said wing 5 being made for example of a metal alloy, such as an aluminium alloy.

Again, in a further embodiment, the joint 12 shown on FIG. 4 includes a material of lesser grade in the middle, for example a recycled PVC and a material with an elaborate surface aspect, especially for the lower visible face of the joint 12, this two-grade structure able to be obtained by co-extrusion.

If necessary, the second lip 21 and flap 14 are made of or coated with a material having a similar aspect or coordinated with that of the visible face 22 of the fabric 1.

Figure 9:
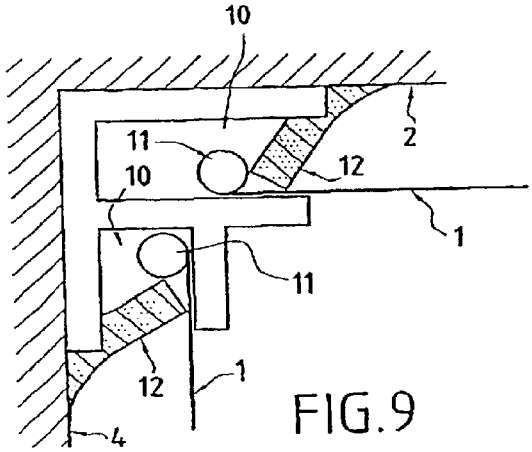
FIG. 9 illustrates a still further embodiment of a rail section according to the present invention.

In the embodiment of FIG. 9, the C-shaped groove making it possible to mount the linking rectangular bars or squares between successive sections is placed protruding onto the internal face 24 of the internal wing 7. Of course, the arrangement of said C-shaped groove could, in a variant, be as shown on FIGS. 1 and 2.

As in the embodiment of FIG. 1, the hip-joint 14 shown on FIG. 4 can be provided in certain places with airing traversing holes.

The excessive thickness 11 in the shape of a hook in FIG. 4 can, in one embodiment variant, be kept tight in the groove 10 by being supported against the internal face 15 of the internal wing and against the internal face of the external wing 9.

Figure 5:
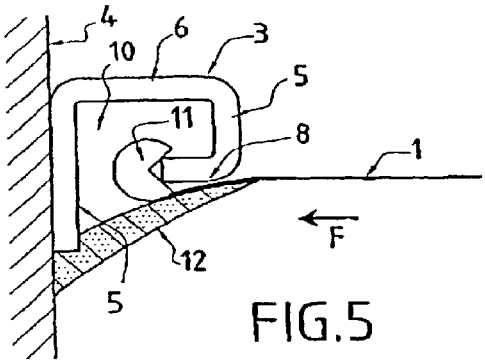
FIG. 5 illustrates a still further embodiment of a rail section according to the present invention.

Reference is now made to FIG. 5.

In the embodiment of FIG. 5, the section 3 made of a bimaterial comprises a joint 12 duplicate moulded or co-extruded onto the external the wing 5 of the edge of a groove with a P-shaped section. The edge of the fabric 1 comprises an already known "fish-hook" hooked against the extreme edge of the internal wing of the rail section, said extreme edge being approximately placed perpendicular to the external wing 5. The joint plates the fabric 1 against the internal wing 5 and masks the opening of the groove 10. The fish-hook is introduced for example with spatula and manoeuvred along the arrow F of FIG. 5.

Figure 6:
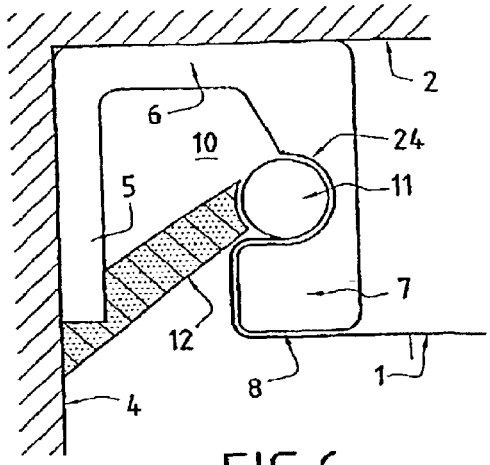
FIG. 6 illustrates a still further embodiment of a rail section according to the present invention.

Reference is now made to FIG. 6 which illustrates an embodiment variant in which the excess thickness 11 placed on the edge of the fabric 1 is plated under the effect of the joint 12 into a specific reserved space 24 in the internal wing 7 of the rail section 3.

Figure 7:
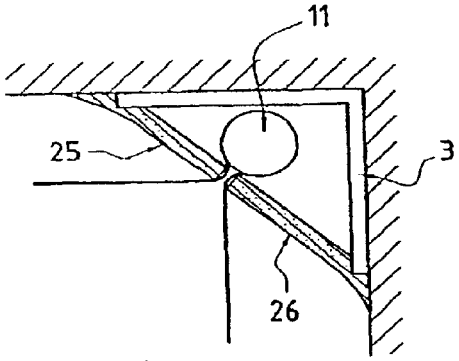
FIG. 7 illustrates a still further embodiment of a rail section according to the present invention.

FIG. 7 diagrammatically illustrates the placing of a snap ring in an angle section between two walls, the angle section comprising two duplicate moulded or co-extruded joints 25, 26.

Figure 8:
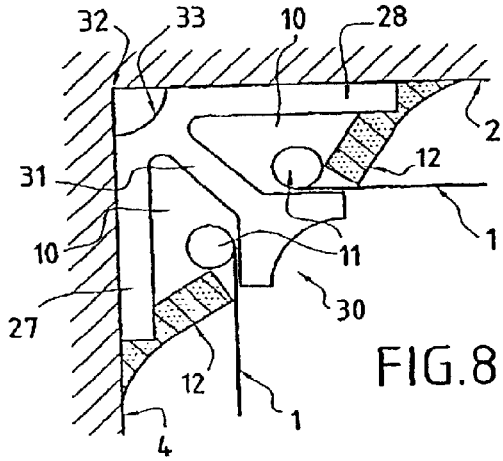
FIG. 8 illustrates a still further embodiment of a rail section according to the present invention.
Figure 10:
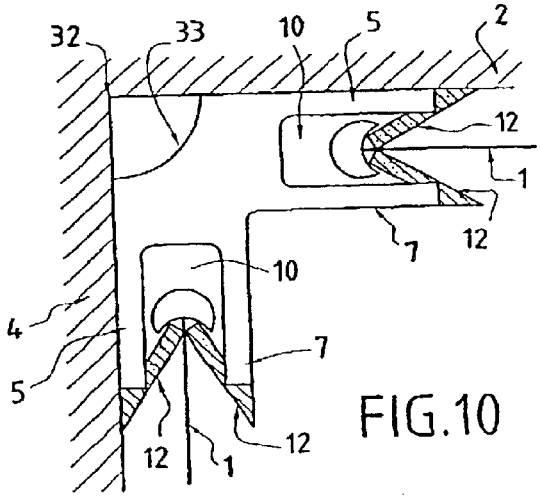
FIG. 10 illustrates a still further embodiment of a rail section according to the present invention.

The embodiments diagrammatised on FIGS. 8, 9 and 10 relate to sections comprising two grooves in each of which the edge of a fabric can be placed and kept in place.

In the embodiment of FIG. 8, the angle section 30 comprises two external wings 27, 28 fixed against two approximately perpendicular walls, said fixing being obtained by means (not shown), such as screws or the like. The angle section moreover comprises a central wing 31 extending approximately at 45° with respect to the external wings 27, 28. Two pseudo U-shaped cross-sectional grooves 10 with bent inward base wall are thus formed, an excess thickness 11 integral with the edge of a fabric 1 able to be introduced inside said grooves and kept in place by means of joints 12 in a way similar to the way described with reference to the preceding figures. So as to avoid any possible problems occurring relating to an irregularity of the angle line 32 defined by the two walls, the section 3 comprises an indentation 33.

The angle profile diagrammatized on FIG. 9, like that of FIG. 8, comprises two grooves 10 but in which their cross-section is shaped like a straight U, a intermediate wing with a T-shaped section protruding from one of the external wings of the 1 section.

In the embodiment of FIG. 10, the angle section 3 comprises two U-shaped grooves each defined by an external wing and an internal wing, each of the wings bearing a joint 12 slanted towards the inside of the groove, the edge of the fabrics placed in the grooves 10 including a fish-hook able to take support against the internal face of the joints.

Figure 11:
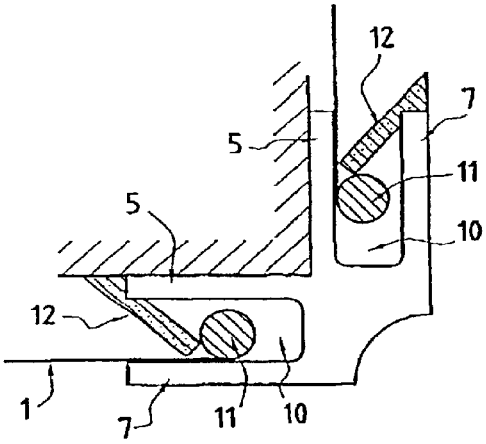
FIG. 11 illustrates a still further embodiment of a rail section according to the present invention.

FIG. 11 shows an embodiment of a section 3 for the wall angle, the placing and support of the edges of the fabric being obtained in a similar way to the one already described with reference to FIGS. 8 to 10.

Figure 12:
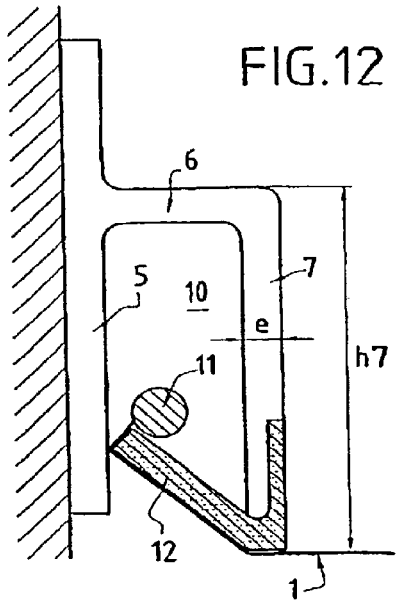
FIG. 12 illustrates a still further embodiment of a rail section according to the present invention.

Reference is now made to FIG. 12 which diagrammatically illustrates an embodiment of the section in which the joint 12 is borne by the internal wing of the groove 10. When the joint 12 is obtained by duplicate moulding on an internal wing 7 made of a metal alloy, it is possible, as shown, to provide that the material constituting the joint "projects" onto the external face or the internal face of the internal wing 7 and over a portion of its height h7.

Figure 13:
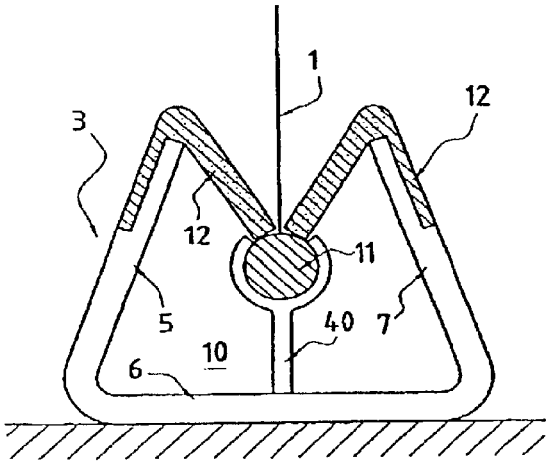
FIG. 13 illustrates a still further embodiment of a rail section according to the present invention.

In the embodiment of FIG. 13, the groove 10 of the section has a pseudo U-shaped cross-section, its two lateral walls being slanted inwardly, the width of the groove decreasing from its base wall 6 to its opening. Each lateral wall 5, 7 bears a joint 12 derived from duplicate moulding or co-extruded with the rest of the section 3. The base wall 6 of the groove 10 bears protruding in certain places or over the entire length of the section 3 a ductile element 40 forming a cradle for receiving and catching a snap ring 11 integral with the edge of the fabric 1. The keeping of the fabric in position inside the section is thus obtained via the combined action of:

- the general elasticity of the walls 5, 7 of the section, these walls being for example made of a metal alloy or a rigid polymer and acting via their geometry in the way of a clamp;
- the support of the snap ring 11 against the joints 12, the freeing of the snap ring involving a significant warping of these joints 12;
- the resistance of catching of the snap ring 11 in the piece 40.

Figure 14:
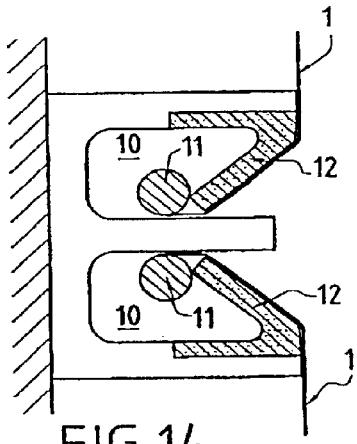
FIG. 14 illustrates a still further embodiment of a rail section according to the present invention.

In the embodiment of FIG. 14, the section is an E-shaped cross-section, each of the two grooves 10 of the section being provided with a joint as shown as a reference on FIG. 12.

In, the embodiment of FIG. 15, a variant of the embodiment described with reference to FIG. 12, the groove 10 of the section is defined firstly by an internal wing 7 and secondly by the wall on which said section 3 is fixed. The joint 12 is of the type of the one described with reference to FIG. 12 and the section is provided with a C-shaped groove for mounting squares or flat parts of the general type shown on FIG. 1.

Figure 15:
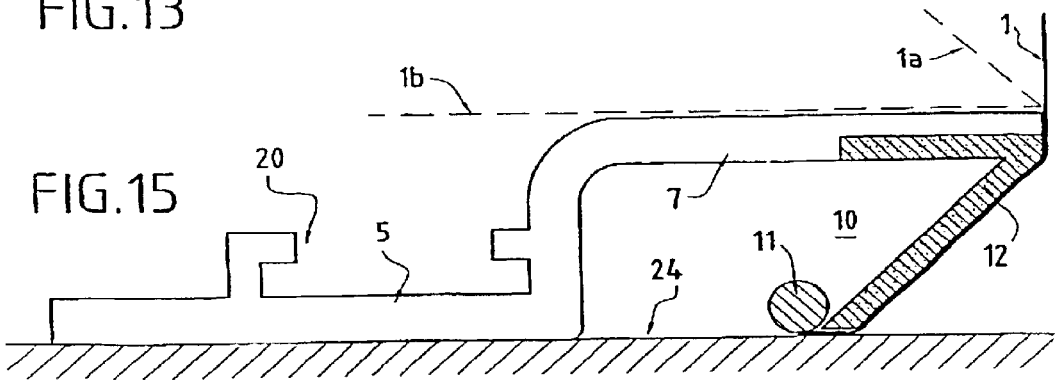
FIG. 15 illustrates a still further embodiment of a rail section according to the present invention.

As diagrammatised by the lines 1*a*, 1*b* on FIG. 15, in the embodiment of FIG. 15, the fabric 1 is not necessarily stretched perpendicular to the fixing wall of the section 3, but can be slanted (1*a*) or approximately parallel to the latter (1*b*).

The rail sections described above can be used for stretched fabric structures for decoration, masking or display, especially false ceilings, false walls in hospital and industrial environments or for collective equipment, and modern or historical dwellings.

What is claimed is:

1. A rail section for stretched fabric false partitions affixed to a mounting surface, said rail section comprising:

- a groove defined by an internal wing, an external wing and a base;
- an interval adjacent to the external wing and separating the external wing from a mounting surface;
- a joint including a lip, and a flap outside the groove, said flap extending outward from said external wing toward said mounting surface;
- said lip being shaped and configured to pinch the fabric of the false partition between said lip and said internal wing;
- wherein the lip is approximately flat, an internal face of the lip being approximately parallel to an external face of the lip;
- wherein the lip has a free edge that is disposed inside the groove.

2. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the joint has a single lip that extends at an angle of less than 65° with respect to the external wing.

3. Rail section according to claim 2, wherein the lip has a free edge that is disposed inside the groove.

4. Rail section according to claim 3, wherein the lip has a free edge of the face edge of the lip is in support against the lateral wing of the groove opposite the external wing.

5. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip of the joint comprises an internal face oriented towards the base of the groove and an external opposing face, the internal face and the external face of the joint not being parallel to each other;

wherein the lip has a free edge that is disposed inside the groove.

6. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip of the joint comprises an internal face oriented towards the base of the groove and an external opposing face, the internal face and the external face of the joint not being parallel to each other;

wherein the internal face of the lip extends at an angle less than 65° with respect to its external wing.

7. Rail section according to claim 6, wherein the lip has a free edge that is disposed inside the groove.

8. Rail section according to claim 7, wherein the free edge of lip is in support against the internal wing of the groove opposite the external wing.

9. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip comprises a first and a second lip, each lip projecting from either one of the internal or external wings of said groove, an internal face of the first lip being oriented towards the base of the groove and slanted with respect to at least one of the wings, an external face of the second lip opposite the base of the groove being perpendicular to at least one of the wings.

10. Rail section according to claim 9, wherein the first lip has a free edge that is in support against the internal wing of the groove opposite the external wing.

11. Rail section according to claim 9, wherein the Internal face of the first lip is slanted by an angle of less than 65° with respect to the external wing.

12. Rail section according to claim 9, wherein the external wing has an extreme portion, the first and second lips projecting from said extreme portion.

13. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip comprises first and second lips, each lip projecting from one of the external wings of said groove and comprising an internal face opposite the base of the groove and an external opposing face.

14. Rail section according to claim 13, wherein the first and second lips are approximately symmetrical with respect to a plane perpendicular to the base of the groove and extending halfway between the internal and external wings of the groove.

15. Rail section according to claim 13, wherein the internal face of at least one of the first and second lips is slanted at an angle of less than 65° with respect to the lateral or external wing from which the slanted lip extends.

16. Rail section according to claim 13, wherein the external face of at least one of the first and second lips extends perpendicular to internal or external wing from which the lips extend.

17. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the cross-section of said groove is in general shaped like a V or U, the extreme portions of the lateral walls of the groove opposite the base wall of the groove defining an opening at least partially sealed off by the joint retaining the edge of the stretched fabric;

wherein the internal and external wings are made of an approximate y rigid material selected from the group comprising metal alloys and rigid polymers, the joint being made of a substantially flexible material, such as a flexible polymer.

18. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the rail section is obtained by co-extrusion or duplicate moulding of different materials, namely a first material constituting the substantially rigid internal and external wings and a second material constituting the joint.

19. Rail section according to claim 18, wherein the internal and external wings are made of a rigid PVC-based material, the joint being made of a flexible PVC.

20. A rail section for stretched fabric false partitions affixed to a mounting surface, said rail section comprising:

a grove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein said internal wing is approximately parallel to a lower portion of the external wing, and an upper portion of the external wing comprising a C-shaped groove able to receive means for assembling two rail sections.

21. A false wall comprising a stretched fabric fixed along its edges to a support fixed onto a mounting surface in a room, said support comprising a rail formed of rail sections according to claim 1, wherein the edge of said fabric is provided with an excess thickness taking support against an internal face of the joint;

wherein said false wall is and used as a false ceiling, the groove for the rail section being oriented downwards, the internal and external wings of the groove being approximately vertical, the external wing of the groove being mounted close to the mounting surface and the internal wing of the groove being situated towards the inside of the room, the external wing having a lower extreme portion, the joint extending from said lower extreme portion, the excess thickness of the edge of the fabric being forcefully introduced upwards between a free edge of the joint and the internal wing of the groove so that said excess thickness takes support both against an internal face of the joint and an internal face of the internal wing of the groove, the fabric stretched horizontally being thus deviated upwards so as to penetrate into the groove of the rail section whilst taking support on a lower extreme edge of the internal wing of the groove;

wherein two internal and external wings of the groove have approximately identical heights, the external face of the joint being disposed perpendicular to the internal and external wings, and in the continuity of the stretched fabric.

22. A rail section for stretched fabric false partitions affixed to a mounting surface, said rail section comprising:

a groove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip is approximately flat, an internal face of the lip being approximately parallel to an external face of the lip; wherein the lip of the joint extends approximately perpendicular to the external wing;

wherein:

the lip has a free edge that is disposed inside the groove;

a free edge of the lip is in support against the internal wing of the groove opposite the external wing.

23. A rail section for stretched fabric false partitions affixed to a mounting surface, said rail section comprising:

a groove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip is approximately flat, an internal face of the lip being approximately parallel to an external face of the lip;

wherein:

the lip of the joint extends at an angle of less than 65° with respect to the external wing;

the lip has a free edge that is placed inside the groove;

the free edge of the lip is in support against the internal wing of the groove opposite the external wing;

the external wing has an extreme portion, the lip projecting from said extreme portion.

24. A rail section for stretched fabric false partitions affixed to a mounting surface, said rail section comprising:

a groove defined by an internal wing, an external wing and a base;

an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein:

the lip of the joint comprises an internal face orientated towards the base of the groove and an external opposing face, the internal face and the external face of the lip not being parallel to each another;

the internal face of the lip of the joint extends approximately perpendicular to the external wing;

the lip has a free edge that is disposed inside the groove;

the free edge of the lip is in support against the internal wing of the groove opposite the external wing.

25. A rail section for stretched fabric false partitions affixed to a mounting surface, said rail section comprising:

a groove defined by an internal wing, an external wing and a base an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the lip of the joint comprises an internal face orientated towards the base of the groove and an external opposing face, the internal face and the external face of the joint not being parallel to each other, wherein the internal face of the lip of the joint extends approximately perpendicular to the external wing;

the internal face of the lip of the joint extends at an angle less than 65° with respect to the external wing;

the free edge of the lip is disposed inside the groove;

the free edge of the lip is in support against the internal wing of the groove opposite the external wing;

the external wing has an extreme portion, the lip projecting from said extreme portion;

the external face of the lip of the joint extends approximately perpendicular to the internal and external wings of the groove.

26. A rail section for stretched fabric false partitions affixed to a mounting surface, said rail section comprising:

a groove defined by an internal wing, an external wing and a base; an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the cross-section of said groove is in general shaped like a V or U, the extreme portions of the lateral walls of the groove opposite the base wall of the groove defining an opening at least partially sealed off by the joint retaining the edge of the stretched fabric;

the lip comprises a first and a second lip, each lip projecting from either one of the internal or external wings of said groove, an internal face of the first lip being orientated towards the base of the groove and slanted with respect to at least one of the wings, an external face of the second lip opposite the base wall of the groove being perpendicular to at least one of the wings;

the first lip has a free edge that is in support against the internal wing of the groove opposite the external wing;

the internal face of the first lip is slanted at an angle of less than 65° with respect to the external wing;

the external wing has an extreme portion, the first and second lips projecting from said extreme portion.

27. A rail section for stretched fabric false partitions affixed to a mounting surface, said rail section comprising:

a groove defined by an internal wing, an external wing and a base; an interval adjacent to the external wing and separating the external wing from a mounting surface;

a joint including a lip, and a flap outside the groove, said flap extending outward from said external wing toward said mounting surface;

said lip being shaped and configured to pinch the fabric of the false partition between said lip and said internal wing;

wherein the cross-section of said groove is in general shaped like a V or U, the extreme portions of the lateral walls of the groove opposite the base wall of the groove defining an opening at least partially sealed off by the joint retaining the edge of the stretched fabric;

the lip comprises a first and second lip, each lip projecting from either one of the internal or external wings of said groove and having an internal face opposite the base of the groove and an external opposing face;

the first and second lips being approximately symmetrical with respect to a plane perpendicular to the base of the groove and extending halfway between the internal and external wings of the groove;

the internal face of at least one of the lips being slanted by an angle of less than 65° with respect to the internal or external wing from which the slanted lip extends;

the external face of at least one of the two lips extends perpendicular to internal or external wing from which lips extend;

the internal and external wings of the groove are made of an approximately rigid material selected from the group comprising metal alloys and rigid polymers, the joint being made of a substantially flexible material, such as a flexible polymer;

the rail section is obtained by co-extrusion or duplicate moulding of different materials, namely a first material constituting the substantially rigid wings of the groove, and a second material constituting the joint;

the wings of the groove are made of a rigid PVC-based material, the joint being made of a flexible PVC;

said internal wing being approximately parallel to a lower portion of the external wing, and an upper portion of the external wing comprising a C-shaped groove able to receive means for assembling two rail sections.

* * * * *